United States Patent [19]

Trombley et al.

[11] 3,971,163

[45] July 27, 1976

[54] ABRASIVE TAPE APPARATUS FOR CONTOURING A FLEXIBLE LENS

[75] Inventors: Wayne E. Trombley; Lawrence R. Jacobson, both of Midland, Mich.

[73] Assignee: Dow Corning Corporation, Midland, Mich.

[22] Filed: Dec. 23, 1974

[21] Appl. No.: 535,870

[52] U.S. Cl. ..... 51/62; 51/142; 51/145 R

[51] Int. Cl.[2] ..... B24B 13/00; B24B 21/02

[58] Field of Search ..... 51/62, 135 R, 142, 145 R, 51/55; 31/147

[56] References Cited

UNITED STATES PATENTS

| | | | |
|---|---|---|---|
| 2,258,733 | 10/1941 | Brackett | 51/62 |
| 2,453,972 | 11/1948 | Clave et al. | 51/62 |
| 3,238,676 | 3/1966 | Borish | 51/284 |

*Primary Examiner*—Al Lawrence Smith
*Assistant Examiner*—Nicholas P. Godici
*Attorney, Agent, or Firm*—Howard W. Hermann

[57] ABSTRACT

This is a method and apparatus for machining a flexible silicone contact lens which utilizes a moving, flexible abrasive tape bearing against the rotating lens to accomplish the desired result. The tape travels in a transverse direction across the lens and may be oscillated to provide a more uniform finish.

1 Claim, 4 Drawing Figures

ABRASIVE TAPE APPARATUS FOR CONTOURING A FLEXIBLE LENS

BACKGROUND OF THE INVENTION

Contouring or finishing articles formed of non-rigid materials such as silicone or organic rubbers, for example, has heretofore been quite difficult. Due to the nature of the materials, the article tends to flex, deform, or become distorted when engaged by the finishing tool. Furthermore, these characteristics are accentuated when the article is extremely thin as in the case of the contact lens. In the past, these articles have been frozen to impart enough rigidity to allow machining. The patent to Gomond, U.S. Pat. No. 3,750,272 which discloses freezing the soft contact lens using a spray of cooling fluid is an example of the freezing approach. Some of the problems of this approach is that certain materials require freezing temperatures which are difficult to achieve, the temperatures generated by the machining operates to bring the temperature of the article above its melting point and return it to its flexible state and finally in the frozen state such articles become very brittle leading to breakage. In the patent to Schpak et al., U.S. Pat. No. 3,423,886 the article, in this case a "soft" contact lens is secured to a mandrel and then rotated at high speeds so that centrifugal force imparts internal stresses in the edge which neutralize stresses induced by engagement with the forming element. The patent to Schrier, U.S. Pat. No. 3,736,183 discloses a method of centering lenses which increase the efficiency of the contouring or finishing provided by the centrifugal method.

Another method which has been proposed for machining an object formed of a non-rigid material is to sandwich the object between two pieces of a rigid material and machine the object while it is so held. In still another method which has been proposed, the object is encapsulated in a rigid medium, e.g., wax, and machined while it is encapsulated. Neither method, however, provides the accuracy which is desired in many applications, and hence, neither is acceptable for many applications. As disclosed by the reference patents, there are broadly speaking, three steps to manufacturing a molded soft contact lens. Namely, the molding steps, trimming and edging steps, and finally a finishing step. Part of this finishing step is to provide the lens with an edge portion which will not have any sharp portion which may cause pain to a patient wearing it while at the same time being thin enough to allow an efficient fit.

SUMMARY OF THE INVENTION

The inventors have, by utilizing a flexible, abrasive tape as the cutting medium coupled with the mentioned high speed rotational approach, devised means of finishing a lens including contouring the edge so that there are no indications of any pain when a patient wears the same. In some cases thinning of the lens edge is accomplished by a grinding operation which leaves a ridge at the boundary between the ground portion of the lens or bed and that which is not ground (i.e., the optical surface). This particular portion may be referred to as a bevatic bump or ridge and the lens contouring machine disclosed herein is particularly effective in removing that bump and, as a matter of fact, until the invention of this machine it was necessary for patients to live with the discomfort caused by this bump if they were wearing a lens having it. Since the threshold of pain varies from individual to individual this particular fault in the lens could create a situation where a patient would be unable to wear it.

The use of a flexible, abrasive tape as the grinding or forming means in the disclosed machine assumes that the grinding surface will substantially conform to the surface to be ground thereby increasing the possibility that the total surface will be finished without skipping any area. The use of rigid grinding or forming means to finish an article particularly one which is both arced and flexible made it a certainty that there would be unfinished areas unless extremely costly and elaborate equipment was utilized. The use of a tape machine also allowed the inventors to impart a reciprocating accurate motion to the grinding surface improving the imparted surface beyond that which could formerly be obtained.

BRIEF DESCRIPTION OF THE DRAWINGS

Further objects and attendant advantages will become apparent to those skilled in the art from a reading of the following detailed description in conjunction with the accompanying drawings wherein.

DESCRIPTION OF PREFERRED EMBODIMENTS

Figure 1:
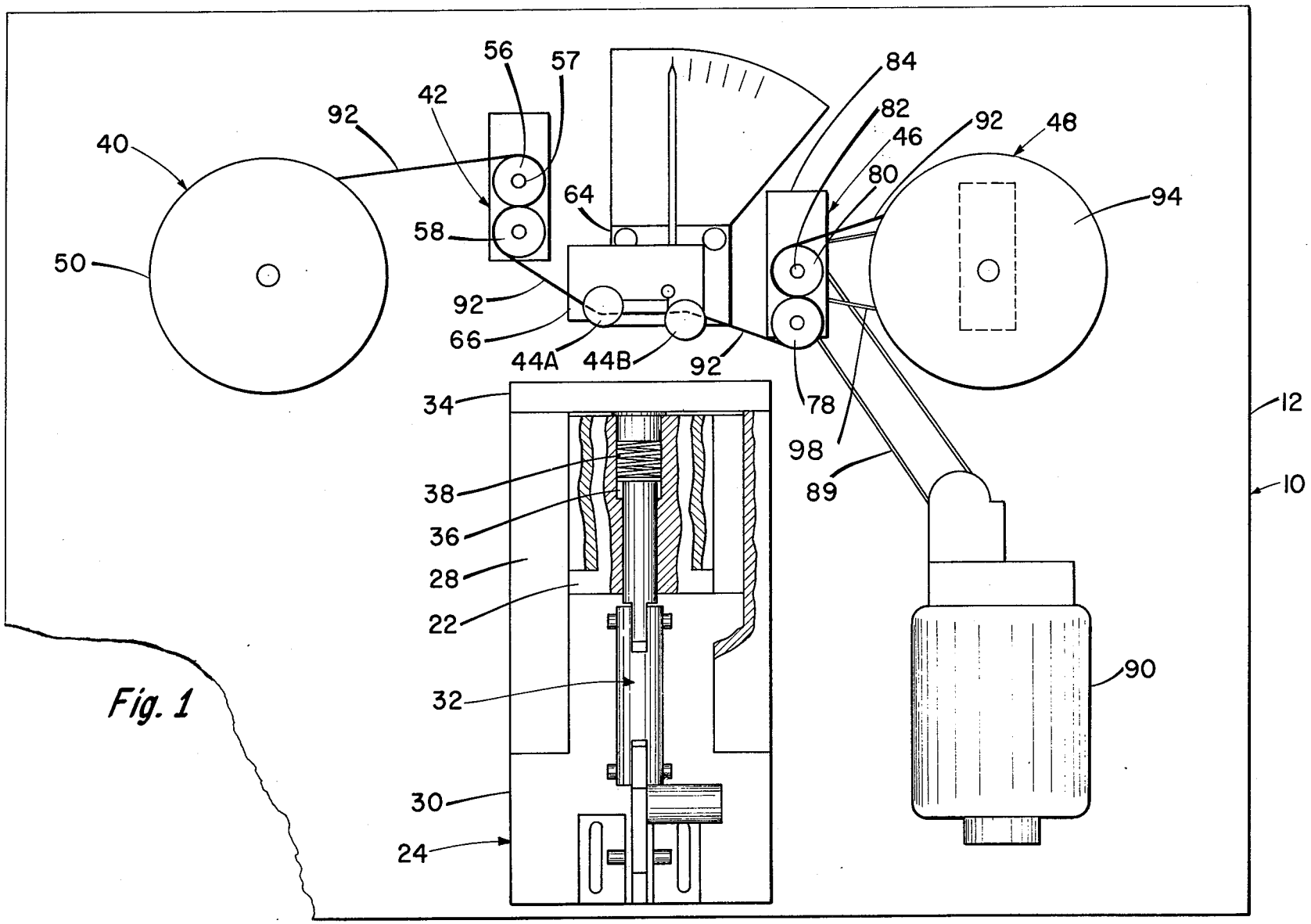
FIG. 1 is a top plan view of the lens contouring machine without the lens holding assembly or its drive motor.
Figure 2:
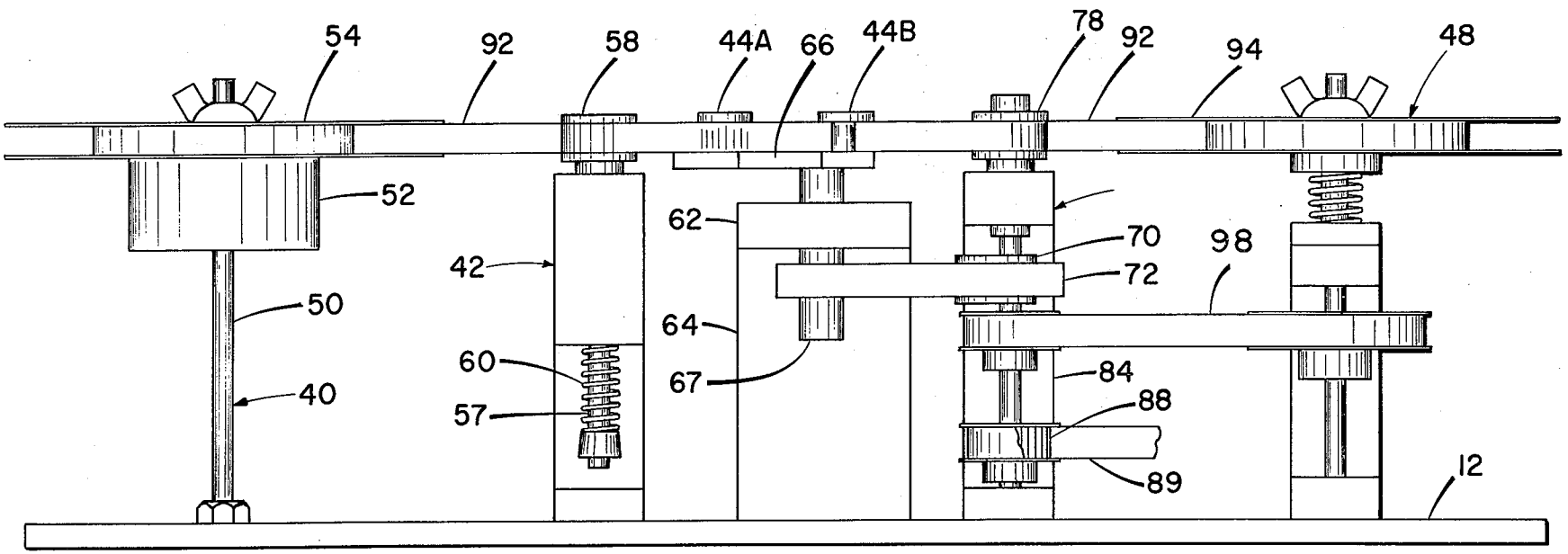
FIG. 2 is an elevated view of the tape drive assembly.
Figure 3:
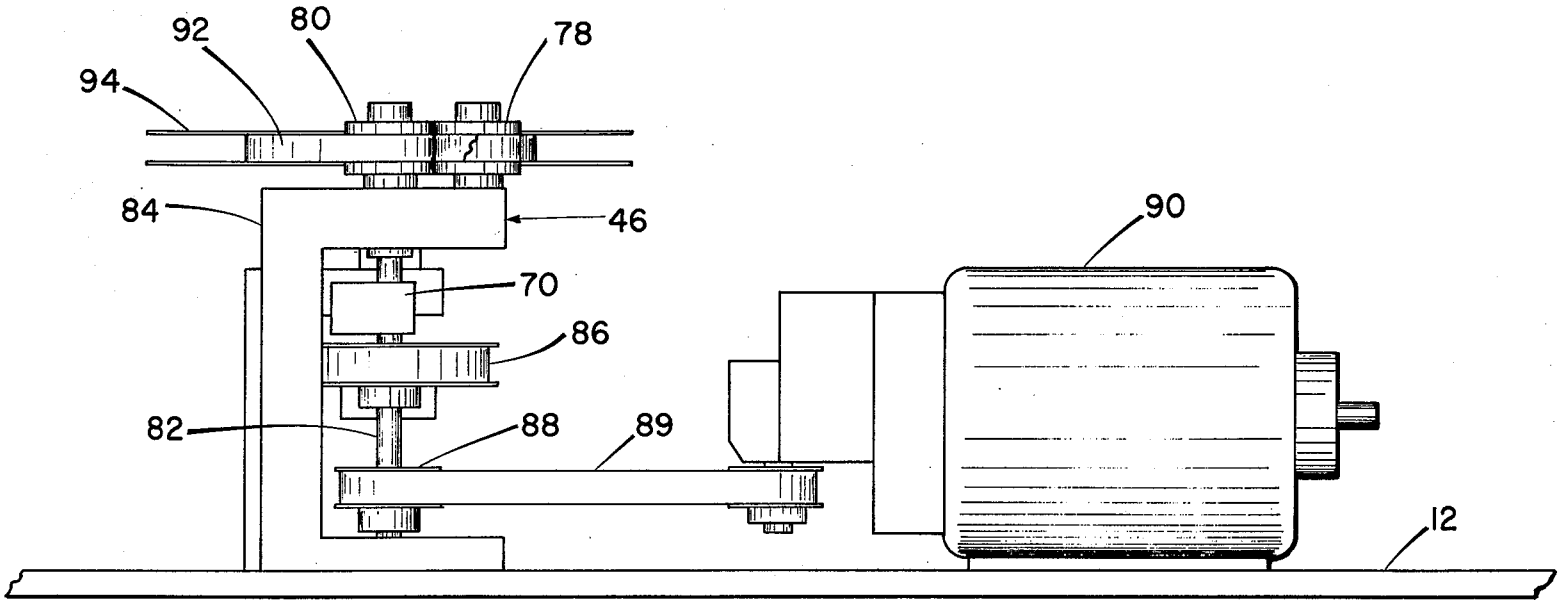
FIG. 3 is a side elevational view of the drive capstan assembly and drive motor.
Figure 4:
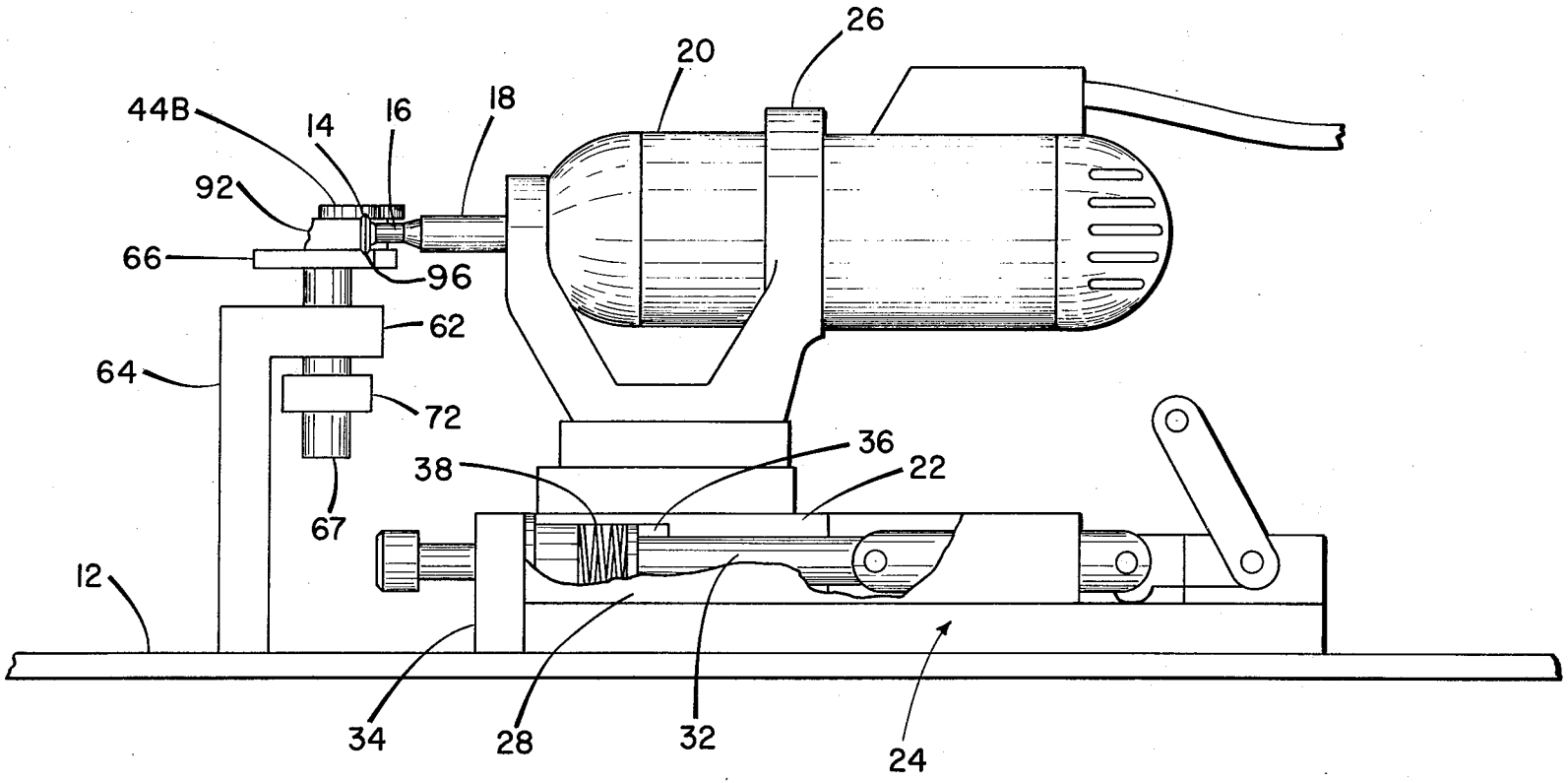
FIG. 4 is a side elevational view of the lens holding assembly, its motor and the slide assembly partly in section and without the pointer and scale.

There is shown in the drawings a lens contouring machine comprising the frame 10, a slide assembly 24, a clutch capstan assembly 42, a tape drive assembly, a tape guide assembly, a drive capstan assembly 46, two variable speed drive motors and a take-up reel mechanism 48. The box-like frame 10 has as its bottom surface a base plate 12. A lens 14 is affixed to a mandrel 16 which is chucked in a precision collet 18 attached to a variable speed motor 20 on the slider 22 of the slide assembly 24. A clamp member 26 is used to hold the motor 20 to the slider 22, on a plane a predetermined distance above the base plate 12. The motor 20 can be advanced or retracted by movement of the slider 22 for purposes to be set forth hereinafter.

The slide assembly 24 comprises the slider 22, a pair of slider guides 28, a base portion 30, toggle linkage 32, and an end plate 34. The slider 22 comprises a rectangular body portion having beveled side edges and the slider guides 28 are rectangular bars which are undercut on a side, are spaced for each other and permanently mounted on the base plate 12 to provide a channel within which the rectangular body portion of the slider 22 reciprocates. The end plate 34 is attached to the two ends of the spaced slider guides 28, across the area defined thereby and has a bolt centrally threaded thereto directed toward the slider 22 to act as an adjustable stop. The toggle linkage arrangement 32 is attached to the slider 22 and is adjustably attached to the base portion 30 allowing an operator to advance the slider 22 toward the end plate 34 or retract it therefrom. The slider 22 includes a bore 36 centrally located in an edge thereof, in spaced parallel relation with the sides and coaxially aligned with the slider linkage 32. A compression spring 38 slidably located within the bore 36 has the linkage 32 bearing against it so that when the slider is in its farthest forward position compressing the compression spring 38 take-up is provided. The slider 22 and the slider guides 28 are made of an inherently lubricious material such as Delrin although other materials such as lubricated hardened steel could be utilized.

The tape drive assembly includes a feed reel mechanism 40, a clutch capstan assembly 42, tape guides 44A, 44B, a drive capstan assembly 46 and a take-up reel mechanism 48. The feed reel mechanism 40 is located to the left on a plane forward of the slide assembly 24 and comprises a feed reel shaft 50 extending from the base plate 12 having its axis on a plane spaced forward of the end plate 34 of the slide assembly 24. An aluminum cylinder 52 is adjustably, coaxially mounted on the feed reel shaft 50 to provide a platform on which the feed reel 54 rests. The adjustability of the cylinder 52 is required because of variances which may occur either in the manufacture of the tape or of the reels.

The clutch capstan assembly 42 spaced to the right of the feed reel mechanism 40 on a plane forward of the end plate 34 comprises a first pinch roller 56 and a second pinch roller 58. The first pinch roller 56 can be mounted on a clutch shaft 57 which rotates a disc of an electromagnetic clutch providing tension or drag to the tape. The inventors in the embodiments shown in the drawings have utilized a clutch shaft 57 which rotates freely in a prelubricated bushing. The degree of drag or torque is controlled by an adjustable spring 60 located at the lower end of the clutch shaft 57.

The tape guide assembly locates the height of the abrasive tape in relation to the lens to be worked on and is angularly adjustable. Height adjustment is provided by a stack of washer-like shims (not shown) mounted on a riser top 62 which extends from a riser plate 64. A tape guide base 66 has the guides 44A, 44B mounted thereon and in turn is pivotally mounted on the riser plate 64 which in turn is attached to the base plate 12. The tape guide base 66 pivots on the riser top 62 through a pivot pin 67 which extends below the riser top 62. The abrasive tape is angularly adjusted in relation to the axis of rotation of the motor spindle which supports the lens. This angular adjustment is accomplished by varying the angle of the tape to a predetermined degree by rotating the tape guide base 66. The angle of the tape is measured in relation to a perpendicular plane drawn transverse to the axis of the motor spindle and is indicated by a pointer mounted on the tape guide base 66 and a scale which extends from the rear of the riser plate 64 beyond the tape guide base 66. This angle of adjustment may vary slightly, but is usually in the range of about 5°–10°. This angle, of course, is not the angle of the tape when it is engaged to the lens since the angularity is changed by that engagement. If a fixed angle is utilized, as has been mentioned heretofore, the quality of the finish applied to the lens will be limited and the amount of contouring that can be achieved will also be limited. On the other hand, is an oscillating angle is utilized the quality of finish can be considerably improved over that available from a substantially fixed angle of the tape and the amount of contouring particularly at the edge of the lens could be substantially increased by oscillation with the added advantage that the amount of tape breakage is considerably reduced. Tape oscillation can be achieved by continually moving the tape guide base 66 back and forth through an arc during the finishing operation. The oscillating motion can be achieved by a cam 70 and a cam follower 72. The cam follower 72 is mounted on the pivot pin 67 on which the tape guide base 66 is mounted below the riser top 62. The cam follower 72 can be spring loaded to insure that it remains in contact with the cam 70 during operation. An adjustable stop may also be provided on the cam follower 72 to limit the angle of oscillation. The cam 70 is mounted on the drive roller drive shaft 82. The drive capstan assembly 46 includes an idler roller 78 and a drive roller 80. The drive roller 80 is mounted on a drive roller drive shaft 82 which is passed through the upper arm of a drive bracket 84 mounted on the base plate 12. The idler roller 78 and the drive roller 80 are positioned in such a way that the tape contacts them both simultaneously to limit slippage. The drive roller drive shaft 82 has an upper pulley 86 and a lower pulley 88 axially attached thereto. The lower pulley 88 is rotated by a timing belt 89 which operates from a variable speed drive motor 90 mounted on a motor bracket which in turn is bolted to the base plate 12. The cam 70 is mounted on the drive roller drive shaft 82 above the upper pulley 86.

To operate the lens contouring machine the tape 92 is threaded from the feed reel 54 around the first pinch roller 56 and then between that roller and the second pinch roller 58 of the clutch capstan assembly 42. The adjustable spring clutch 60 is set to a predetermined amount of drag which will apply tension to the tape 92 stabilizing the finishing zone of the tape 92 during finishing operations. The tape 92 is then threaded through in front of a first tape guide 44A and in back of the second tape guide 44B providing a finishing zone between the guides with the abrasive material of the tape facing the precision collet 18 of the variable speed motor 20. From the tape guides 44A, 44B the tape 92 is passed around the idler roller 78 and between it and the drive roller 80 and then around the drive roller 80 to the empty take-up reel 94 mounted on the take-up reel mechanism 48. The height of the aluminum cylinder 52 mounted on the feed reel shaft 50 of the feed reel mechanism 40 is factory adjusted to assure that the tape 92 tracks at the proper height with respect to the pinch rollers 56, 58 and thereby assures proper setting for tracking throughout the finishing operation. The shims on the riser top 62 are placed in position to insure that the tape guide base 66 and the tape guides 44A and 44B mounted thereon are at the proper height. The tape 92 is Mylar coated with chrome oxide, the Mylar being 6.35 mm. wide and 1 ½ mm. thick. Silicone carbide or aluminum oxide abrasives could be used if desired rather than chrome oxide. The size of the particles of abrasive should be in the range between 0.5 to 32 microns.

Continuing with the operation of the lens contouring machine the lens 14 mounted on the mandrel 16 is placed in the precision collet 18 with the bevatic bump facing the tape 92. During the loading operation the slide assembly 24 is in a retracted position. After loading the slide assembly 24 is then manually advanced by moving the toggle linkage arrangement 32 to the forward or run position. In this position the compression spring 38 within the slider 22 is compressed to a predetermined amount and the mounted lens 14 contacts the tape 92 deflecting the tape 92 to a predetermined degree. The compression spring 38 assures that the slider assembly remains in a run position with the forward face of the slider 22 abutted against the adjustable stop.

The operator simultaneously actuates the variable speed drive motor 90 and the variable speed motor 20. The variable speed drive motor 90 drives the drive roller drive shaft 82 through the timing belt 89. The drive roller drive shaft 82 rotates the drive roller 80 in a clockwise direction moving the tape 92 from the feed reel 54 at a predetermined speed between 2 and 8 feet per minute although this range may be varied. The take-up reel 94 is driven via the take-up mechanism through a drive belt 98 from the upper pulley 86 which in turn is driven by the drive roller drive shaft 82. The rotation of the take-up reel 94 does not drive the tape 92 but merely winds it up. As the tape 92 moves, the lens 14 is rotated in a clockwise direction against the abrasive of tape 92. It has been found that for lenses of the size and material described rotational speeds in the range of 20,000 to 45,000 revolutions per minute are most satisfactory although speeds up to 200,000 revolutions per minute are practical. The axis of rotation of the spindle of the motor 20 is perpendicular to the plane on which the periphery of the lens 14 lies. A section of the tape 92 arches transversely across the bevatic bump 96 subjecting it to the grinding and finishing action. In effect the tape 92 ultimately assumes the outline of the desired contour or profile of the lens by removing the bevatic bump 96. The action of the tape 92 also removes surface irregularities which occured during the edge thinning operation. This can be accomplished by the fixed tape guide base embodiment of the machine. It is desirable to obliterate the sharpness of the transition area between the bevel and the optical surface. By oscillating the tape in an arc rather than fixing it in position the inventors have increased overall the amount of surface of the lens, in contact with the abrasive material thereby blending the said transition area in a desirable manner. The oscillation may be cyclical or a single pass whichever is preferred. Rotation of the drive roller drive shaft 82 rotates the cam 70 against which the cam follower 72 rides, moving it, which in turn pivots the tape guide base 66 thereby achieving the desired oscillation.

We claim:

1. An apparatus for machining an article formed of a non-rigid material comprising an abrasive tape having an article engaging area, abrasive tape carrying and moving means including means for oscillating the article engaging area of the abrasive tape through an arc; and article holding means having means for moving the article into engagement with the abrasive tape, the tape being unsupported except at points spaced from the article engaging area during engagement of the article with the tape.

* * * * *